US007145260B2

(12) United States Patent
Kim

(10) Patent No.: US 7,145,260 B2
(45) Date of Patent: Dec. 5, 2006

(54) DEVICE TO PREVENT SUDDEN STARTING OF AUTOMOBILES

(75) Inventor: Seok Kim, Ulsan Metropolitan (KR)

(73) Assignee: Hyundai Motor Company, Seoul (KR)

( * ) Notice: Subject to any disclaimer, the term of this patent is extended or adjusted under 35 U.S.C. 154(b) by 62 days.

(21) Appl. No.: 11/025,479

(22) Filed: Dec. 29, 2004

(65) Prior Publication Data

US 2005/0280262 A1 Dec. 22, 2005

(30) Foreign Application Priority Data

Jun. 22, 2004 (KR) ..... 10-2004-0046563

(51) Int. Cl.
*F02N 17/00* (2006.01)

(52) U.S. Cl. ..... 290/38 D; 290/38 E; 290/38 R; 123/179.3

(58) Field of Classification Search ..... None
See application file for complete search history.

(56) References Cited

U.S. PATENT DOCUMENTS 2,668,916 A * 2/1954 Dermond ..... 290/38 E
3,857,043 A * 12/1974 Habasch ..... 290/38 R
5,402,758 A * 4/1995 Land et al. ..... 123/179.3
6,497,209 B1 * 12/2002 Karuppana et al. ..... 123/179.3

FOREIGN PATENT DOCUMENTS

FR 2731971 A1 * 9/1996
JP 01028032 A * 1/1989
JP 2000008906 A * 1/2000

* cited by examiner

*Primary Examiner*—Joseph Waks
(74) *Attorney, Agent, or Firm*—Morgan Lewis & Bockius LLP

(57) ABSTRACT

The device for preventing sudden starting of an automobile includes a starting motor, a power source, a starting switch, a solenoid switch, first and second connecting terminals and an actuator. The starting switch is electrically coupled to the power source. The solenoid switch is mechanically coupled to the starting motor and electrically coupled to the starting switch. The first and second connecting terminals are spaced apart from one another. The first connecting terminal is electrically coupled to the starting motor and the second electrical terminal is electrically coupled to the starting switch. The actuator is disposed between the connecting terminals for effecting an electrical connection between the connecting terminals to apply operating power to the starting motor when both the starting switch is in an ON position and the actuator is supplied with an operating pressure generated by depression of a brake pedal.

15 Claims, 3 Drawing Sheets

DEVICE TO PREVENT SUDDEN STARTING OF AUTOMOBILES

CROSS-REFERENCE TO RELATED APPLICATIONS

The present application is based on, and claims priority to, Korean Application Serial Number 10-2004-0046563, filed on Jun. 22, 2004, the disclosure of which is hereby incorporated by reference herein in its entirety.

FIELD

The present invention relates to devices for preventing sudden starting of automobiles, and more particularly to a device for preventing sudden starting of an automobile adapted to engage a driving of a starting motor determined by ON/OFF operation of a starting switch during start of an engine to depression of a brake pedal to prevent the danger of an accident caused by sudden starting of an automobile.

BACKGROUND OF THE INVENTION

In general, accidents occur when automobiles suddenly start irrespective of any acceleration by a driver during starting of the automobile. An accident caused by the sudden starting is estimated to be caused by an accidental manipulation by a driver, but some causes of accidents involving sudden starting have not been clearly determined. Therefore, it is important to address THIS sudden starting of automobiles regardless of the causes of the occurrences.

SUMMARY

The present invention is adapted to provide a device for preventing sudden starting of an automobile. The device is configured to drive a starting motor operated by a starting switch during the start of an engine only when a brake pedal is depressed. This prevents sudden starting accidents that occur when engines are started.

In accordance with some embodiments of the present invention, the device includes a starting system mounted with a pair of connecting terminals each spaced apart for selectively applying operating power to a starting motor via a solenoid switch based on the ON/OFF operation of a starting switch. An actuator is mounted between the connecting terminals for effecting an electrical connection between the connecting terminals during starting of an engine, only when an operating pressure is generated by depression of a brake pedal.

BRIEF DESCRIPTION OF THE DRAWINGS

For a better understanding of the nature and objects of the present invention, reference should be made to the following detailed description with the accompanying drawings, in which.

DETAILED DESCRIPTION OF THE EMBODIMENT

The preferred embodiment of the present invention will now be described in detail with reference to the accompanying drawings, where the present embodiment is not intended to limit the scope of the present invention, but is provided only for illustrative purposes.

Figure 1:
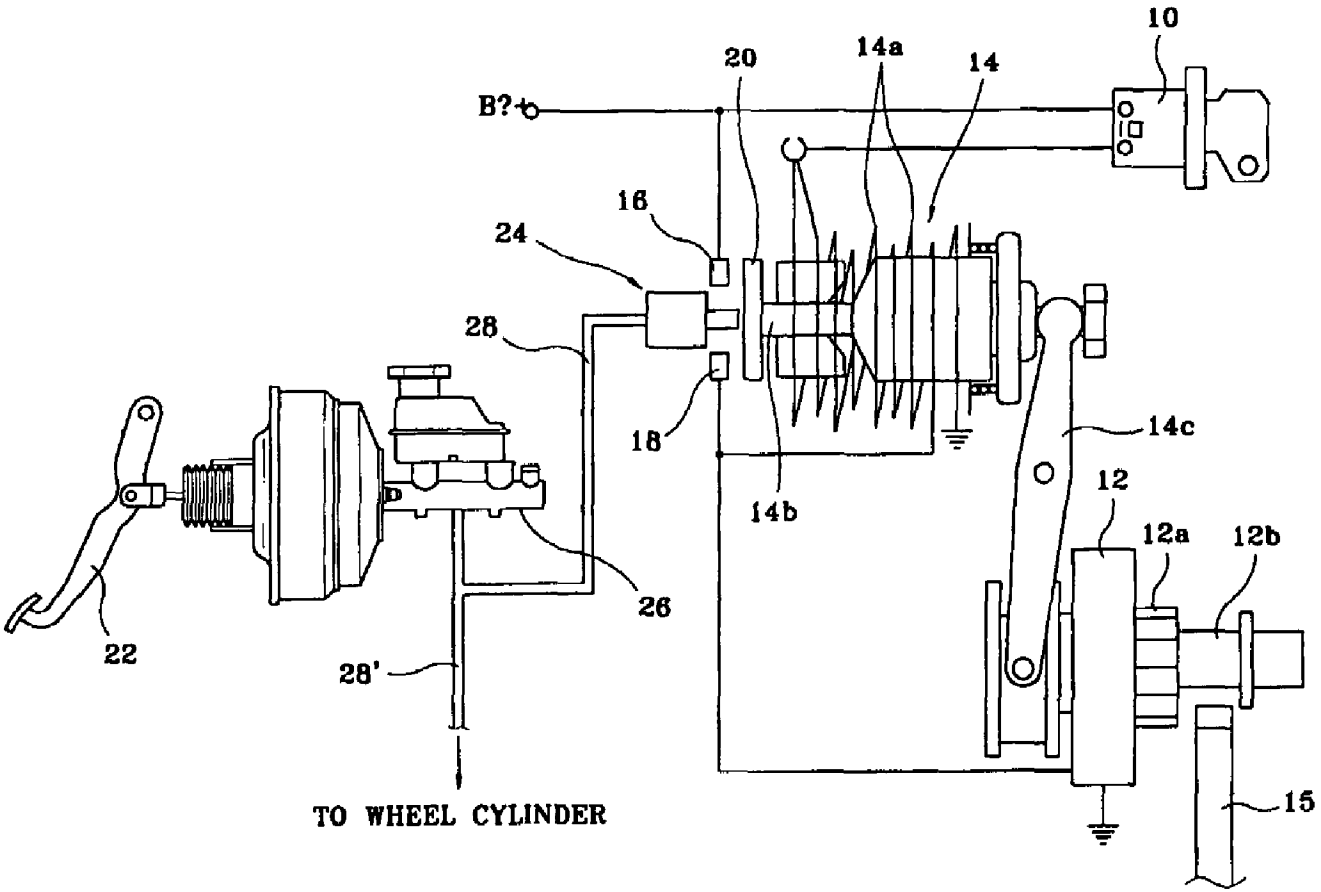
FIG. 1 is a schematic drawing for illustrating a device for preventing sudden starting of an automobile, according to an embodiment of the present invention.

Referring to FIG. 1, a starting system of an automobile includes: a starting switch 10 selectively turned on and off by a starting manipulation of a driver via a starting key during starting of an engine; a starting motor 12 operated by switching a starting switch 10 to an ON state for rotating a fly wheel of the engine during starting of the engine; a battery B+ which is an electric power source mounted in the automobile for supplying operating power necessary for driving the starting motor 12; and a solenoid switch 14 for supplying the electric power of the battery B+ to the starting motor 14 as the operating electric power necessary for driving the starting motor 12 when the starting switch 10 is in an ON state.

A pinion gear 12*a* is movably mounted at a rotational axis 12*b* of the starting motor 12 and rotates a ring gear 15 formed at the flywheel in the shape of an external gear only during the operation of the starting motor 12. The solenoid switch 14 includes: a coil unit 14*a* (pull-in and hold-in coils) for receiving the operating electric power from the battery B+ via the starting switch 10; a plunger 14*b* operated when the coil unit 14*a* is magnetized; and a shift lever 14*c* rotated by movement of the plunger 14*b* to mesh the pinion gear 12*a* of the starting motor 12 with the ring gear 15.

The solenoid switch 14 further includes a first connecting terminal 16 directly connected to the battery B+ and a second connecting terminal 18 connected to the first connecting terminal 16 only when the engine is started and connected to the starting motor 12 for supplying the electric power of the battery B+ to the starting motor 12. Between the first and second connecting terminals 16, 18, a connecting plate 20 is disposed for promoting a connection therebetween by being integrally moved with the plunger 14*b* when the coil unit 14*a* is magnetized.

Meanwhile, between the first and second connecting terminals 16, 18 there is disposed an actuator 24 operated by the operating pressure generated by the depression of a brake pedal 22 to allow an electric connection between the first and second connecting terminals 16, 18. In other words, the device for preventing sudden starting of an automobile according to the present invention includes the actuator 24, being mounted between the first and second connecting terminals 16, 18 for selectively allowing or blocking the electric connection therebetween.

Figure 2:
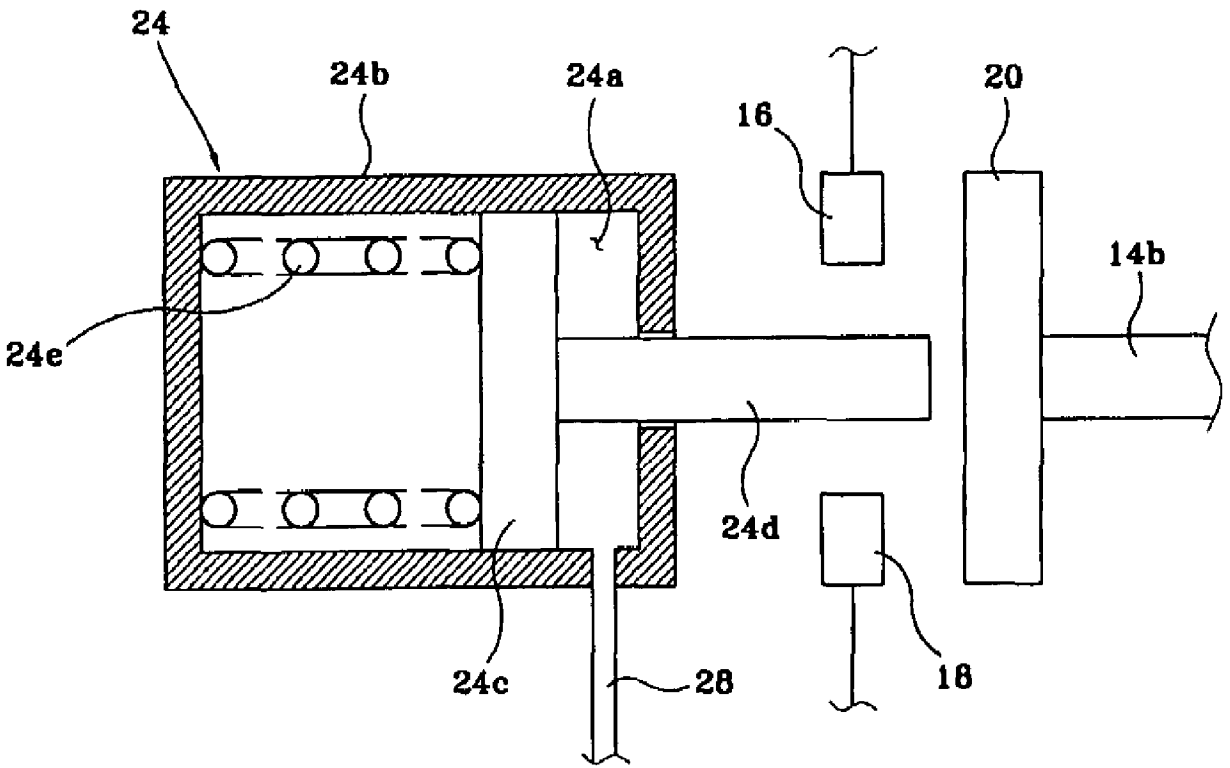
FIGS. 2 and 3 are schematic block diagrams each illustrating construction and an operating state of an actuator shown in FIG. 1.

Referring now to FIG. 2, the actuator 24 includes a housing 24*b* having a pressure chamber 24*a* for receiving the operating pressure via a hydraulic pressure pipe 28 connected to a master cylinder 26 and fixedly mounted at a predetermined location of a vehicle body. The actuator 24 also includes: a piston 24*c* mounted in the pressure chamber 24*a* and moved by the operating pressure; a piston rod 24*d* having a distal tip end coupled to the piston 24*c* and the other distal tip end passing the housing 24*b* to be exposed outside; and a return spring 24*e* resiliently supporting a bottom surface of the piston 24*c*. The elastic force of the return spring 24*e* is so established as to be larger than the moving power of the plunger 14*b* embodied during the magnetization of the coil unit 14*a* at the solenoid switch 14.

The other distal tip end of the piston rod 24*d* is so set up as to be positioned between the first and second connecting terminals 16, 18 when the brake pedal 22 is relieved of depression or released. The hydraulic pressure pipe 28 is branched out from a hydraulic pressure pipe 28' disposed between wheel cylinders (not shown) of each wheel and the master cylinder 26.

When starting switch 10 is turned ON for starting the engine, the electric power source of the battery B+ is applied to the coil unit 14*a* of the solenoid switch 14 to actuate the movement of the plunger 14*b*. The connecting plate 20 at the distal tip end of the plunger 14*b* electrically connects the first and second connecting terminals 16, 18 to apply the operating power of the battery B+ to the starting motor 12. The shift lever 14*c* is rotated by the movement of the plunger 14*b* to mesh the pinion gear 12*a* mounted at the rotational axis 12*b* of the starting motor 12 with the ring gear 15.

In a series of the starting processes, the actuator 24 prevents the connecting plate 20 from being electrically connected between the first and second connecting terminals 16, 18 when there is no supply of operating pressure in the pressure chamber 24*a*, i.e., the brake is not applied.

In other words, the elastic force of the return spring 24*e* of the actuator 24 overcomes the moving force generated during the magnetization of the coil unit 14*a* at the solenoid switch 14 to prevent the connecting plate 20 from being electrically connected between the first and second connecting terminals 16, 18.

Figure 3:
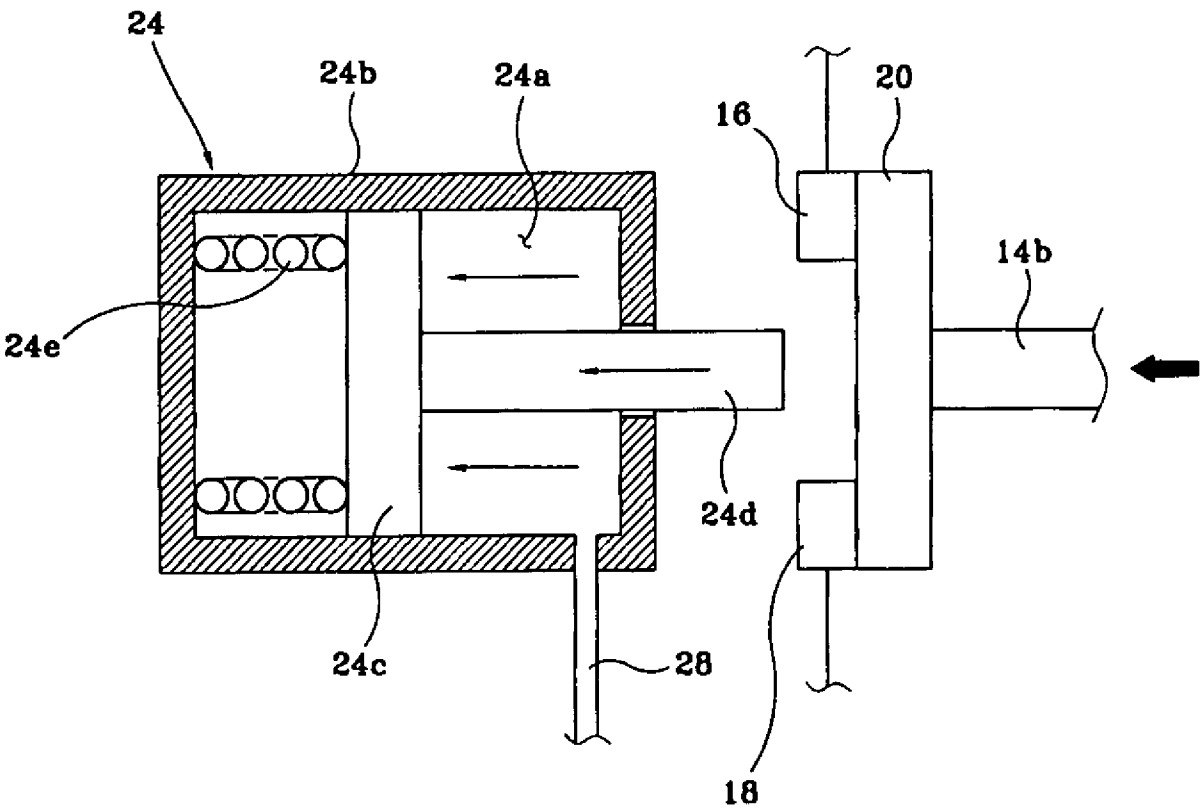

However, when the operating pressure generated from the master cylinder 26 is generated by depressing the brake pedal 22 (i.e., applying the brake) during the start of the engine, pressure is applied into the pressure chamber 24*a* of the actuator 24, and the piston 24*c* overcomes the elastic force of the return spring 24*e* to be retracted as shown in FIG. 3. As a result, the piston rod 24*d* frees itself from the position between the first and second connecting terminals 16, 18 to enable the first and second connecting terminals 16, 18 to be electrically connected by the movement of the plunger 14*b*. In other words, the operating power of the battery B+ is applied to the starting motor 12 only when the brake pedal 22 is depressed, preceded by an attempt to start the engine. This enables a safer start of the engine.

As apparent from the foregoing, there is an advantage in the device for preventing sudden starting of an automobile, in that the operating electric power of the battery B+ is applied to the starting motor 12 only when a braking pressure is supplied to the wheel cylinder by a depression of the brake pedal 22. This avoids an accidental sudden starting of an automobile that occurs during the start of an engine.

The foregoing description of the preferred embodiment of the present invention has been presented for the purpose of illustration and description. It is not intended to be exhaustive or to limit the invention to the precise form disclosed, and modifications and variations are possible in light of the above teachings or may be acquired from practice of the invention. It is intended that the scope of the invention be defined by the claims appended hereto, and their equivalents.

What is claimed is:

1. A device for preventing sudden starting of an automobile having a starting system mounted with a pair of connecting terminals each spaced apart for selectively applying operating power to a starting motor via a solenoid switch according to an ON/OFF operation of a starting switch, wherein an actuator is mounted between the connecting terminals for effecting an electrical connection between the connecting terminals during starting of an engine according to an operating pressure generated by a depression of a brake pedal.

2. The device as defined in claim 1, wherein the actuator comprises: a housing having a pressure chamber for receiving the operating pressure via a hydraulic pressure pipe connected to a master cylinder and fixedly mounted at a predetermined location of a vehicle body; a piston mounted in the pressure chamber and moved by the operating pressure; a piston rod having a distal tip end coupled to the piston and the other distal tip end passing through the housing to be exposed outside; and a return spring resiliently supporting a bottom surface of the piston.

3. The device as defined in claim 2, wherein the elastic force of the return spring is so established as to be larger than the moving power of a plunger during the magnetization of the coil unit at the solenoid switch.

4. The device as defined in claim 2, wherein the other distal tip end of the piston rod is so set up as to be positioned between the first and second connecting terminals when the brake pedal is relieved of depression.

5. The device as define in claim 2, wherein the hydraulic pressure pipe is branched out from a hydraulic pressure pipe disposed between wheel cylinders of each wheel and a master cylinder.

6. A device for preventing sudden starting of an automobile, said device comprising:

a starting motor;

a power source;

a starting switch electrically coupled to said power source;

a solenoid switch mechanically coupled to said starting motor and electrically coupled to said starting switch; and first and second connecting terminals spaced apart from one another, where said first connecting terminal is electrically coupled to said starting motor and said second electrical terminal is electrically coupled to said starting switch;

an actuator disposed between the connecting terminals for effecting an electrical connection between the connecting terminals to apply operating power to said starting motor when both said starting switch is in an ON position to energize the solenoid switch and said actuator is supplied with an operating pressure generated by depression of a brake pedal.

7. The device as defined in claim 6, wherein the actuator comprises:

a housing having a pressure chamber for receiving the operating pressure via a hydraulic pressure pipe connected to a master cylinder and fixedly mounted at a predetermined location of a vehicle body;

a piston mounted in the pressure chamber and moved by the operating pressure;

a piston rod having a distal tip end coupled to the piston and the other distal tip end passing the housing to be exposed outside; and a return spring resiliently supporting a bottom surface of the piston.

8. The device as defined in claim 7, wherein the elastic force of the return spring is so established as to be larger than the moving power of a plunger embodied during the magnetization of the coil unit at the solenoid switch.

9. The device as defined in claim 7, wherein the other distal tip end of the piston rod is so set up as to be positioned between the first and second connecting terminals when the brake pedal is relieved of depression thereof.

10. The device as define in claim 7, wherein the hydraulic pressure pipe is branched out from a hydraulic pressure pipe disposed between wheel cylinders of each wheel and the master cylinder.

11. A device for preventing sudden starting of an automobile, said device comprising:

a solenoid switch configured to be mechanically coupled to a starting motor and electrically coupled to a starting switch; and first and second connecting terminals spaced apart from one another, where said first connecting terminal is configured to be electrically coupled to the starting motor and said second electrical terminal is configured to be electrically coupled to the starting switch;

an actuator disposed between the connecting terminals for preventing said solenoid from electrically connecting said first and second connecting terminals, except when both said starting switch is in an ON position and said actuator is supplied with an operating pressure generated by depression of a brake pedal.

12. The device as defined in claim 11, wherein the actuator comprises:

a housing having a pressure chamber for receiving the operating pressure via a hydraulic pressure pipe connected to a master cylinder and fixedly mounted at a predetermined location of a vehicle body;

a piston mounted in the pressure chamber and moved by the operating pressure; a piston rod having a distal tip end coupled to the piston and the other distal tip end passing the housing to be exposed outside; and a return spring resiliently supporting a bottom surface of the piston.

13. The device as defined in claim 12, wherein the elastic force of the return spring is so established as to be larger than the moving power of a plunger embodied during the magnetization of the coil unit at the solenoid switch.

14. The device as defined in claim 12, wherein the other distal tip end of the piston rod is so set up as to be positioned between the first and second connecting terminals when the brake pedal is relieved of depression thereof.

15. The device as define in claim 12, wherein the hydraulic pressure pipe is branched out from a hydraulic pressure pipe disposed between wheel cylinders of each wheel and the master cylinder.

* * * * *